US007409768B1

(12) United States Patent
Chapman

(10) Patent No.: US 7,409,768 B1
(45) Date of Patent: Aug. 12, 2008

(54) CAN OPENER

(76) Inventor: Samuel Lee Chapman, 1515 W. Rick Ct., Port Huron, MI (US) 48060

( * ) Notice: Subject to any disclaimer, the term of this patent is extended or adjusted under 35 U.S.C. 154(b) by 437 days.

(21) Appl. No.: 11/356,778

(22) Filed: Feb. 17, 2006

Related U.S. Application Data

(60) Provisional application No. 60/678,975, filed on May 9, 2005, provisional application No. 60/753,185, filed on Dec. 22, 2005.

(51) Int. Cl.
*B67B 7/72* (2006.01)

(52) U.S. Cl. ..... 30/426; 30/400; 30/416

(58) Field of Classification Search ..... 30/417, 30/400, 412, 425, 427, 449, 426, 416, 418, 30/443–446, 358, 359, 363
See application file for complete search history.

(56) References Cited

U.S. PATENT DOCUMENTS

| | | | | | |
|---|---|---|---|---|---|
| 1,308,272 | A | | 7/1919 | Berglund | |
| 1,401,821 | A | | 12/1921 | Silverman | |
| 1,521,271 | A | * | 12/1924 | Boon | 30/448 |
| 1,645,385 | A | | 10/1927 | Kaplan | |
| 1,681,667 | A | | 8/1928 | Johnston et al. | |
| 1,861,438 | A | | 6/1932 | Grisko | |
| 2,029,607 | A | | 2/1936 | Brenner | |
| 2,043,654 | A | * | 6/1936 | Donat | 30/447 |
| 2,091,524 | A | * | 8/1937 | Roberts | 30/416 |
| 2,614,320 | A | * | 10/1952 | Rosenberry | 30/418 |
| 2,628,422 | A | * | 2/1953 | Yeomans | 30/417 |
| 2,656,598 | A | * | 10/1953 | Birdsall | 30/445 |
| 2,661,528 | A | * | 12/1953 | Coplen | 30/416 |
| 2,712,176 | A | * | 7/1955 | Delaney et al. | 30/444 |
| 2,716,808 | A | | 9/1955 | Hart | |
| 2,718,056 | A | * | 9/1955 | Burnett | 30/422 |
| 2,784,488 | A | | 3/1957 | Olson et al. | |
| 3,015,886 | A | * | 1/1962 | Miller | 30/447 |
| 3,491,445 | A | | 1/1970 | Gallo | |
| 4,193,191 | A | | 3/1980 | Sisco | |
| 4,389,780 | A | * | 6/1983 | Ostroski et al. | 30/408 |
| 4,502,223 | A | | 3/1985 | Brookfield | |
| 6,282,796 | B1 | | 9/2001 | Lin | |
| 6,516,524 | B1 | * | 2/2003 | Brady | 30/404 |

OTHER PUBLICATIONS

EKCO Model No. 881 Miracle Roll can opener, photocopy.
EKCO Model No. 884 Three-way Miracle can opener, photocopy.
Chapman, S., U.S. Appl. No. 60/753,185, filed Dec. 22, 2005.
Chapman, S. U.S. Appl. No. 60/678,975, filed May 9, 2005.
Chapman., S., U.S. Appl. No. 60/634,375, filed Dec. 8, 2004.

* cited by examiner

*Primary Examiner*—Kenneth E. Peterson
*Assistant Examiner*—Sean Michalski
(74) *Attorney, Agent, or Firm*—Christopher John Rudy

(57) ABSTRACT

Can opener includes frame; rotating, toothed wheel cutting blade; and counterpoised drive wheel. A first, perforating relationship can provide the lid of a can with perforations about its outer boundary for draining liquids; and a second, lid boundary-releasing relationship, which is less than the first distance, can provide for the lid of the can being cut to completely sever it from the remainder of the can.

4 Claims, 1 Drawing Sheet

CAN OPENER

CROSS-REFERENCE CLAIMS OF PRIORITY

This claims benefits under 35 USC 119(e) of provisional patent application Nos. 60/678,975 filed on May 9, 2005 A.D., and 60/753,185 filed on Dec. 22, 2005 A.D. The specifications of those applications, to include drawings, are incorporated herein by reference.

FIELD AND PURVIEW OF THE INVENTION

This invention concerns a can opener for movement along the circumference or other similar boundary of a lid of a can, which, selectively, can punch cut the lid so that liquid contents in the can are able to be drained, or completely cut the lid so that it can be removed for full access to the can contents. The cut can, and methods of making and using the can opener may be of concern.

BACKGROUND TO THE INVENTION

Various can openers are known. Common home can openers of the type for removing lids of cans include a smooth wheel cutting blade, which is driven through the lid through application of pressure against a counterpoised serrated drive wheel that is applied under a lip of the can just outside the lid, and moved along the circumference of a round can or the other similar boundary of another shaped can such as of a round cornered rectangular type by rotation of the serrated wheel. The advent of squeeze handles, although adding bulk to a small hand held can opener such as EKCO's Model-881 Miracle Roll can opener, improved the performance of the manual can opener, with the addition of electric motor power providing for less effort and greater speed.

Many canned goods, however, include a substantial quantity of liquid water or broth. Frequently, it is desired to drain such a liquid before accessing the remaining solid food.

In addressing the lattermentioned desire to drain the liquids from such cans, it is known to simply take the smooth wheel type can opener and make a cut partially around the circumference of the lid, leaving the lid on and draining the contents; or to take a punch type can opener intended for making opposing triangularly shaped holes about the circumference of the lid to drink or pour out its liquid contents as for now obsolete, simple beverage cans, and with that device make a few small holes in the lid, and then draining the contents. Various other art of the latter type is known. See, e.g., U.S. Pat. Nos. 1,861,438 to Grisko for a can punch; 2,029,607 to Brenner for a can punch; and 2,716,808 to Hart for an attachment for punching and clearing pouring openings in can tops. Such are cumbersome, and dripping is encountered.

In further addressing the desire to open a can to access its solid contents after inside liquid has been drained away, it is known in addition to the foregoing art to either pry a partially opened lid open, which can be a cause of severe cuts; or to fully open the lid, say, with a smooth wheel type can opener.

Little if any art is known to address both needs in one can opener, save that partial and complete cuts may be made by those who know the "trick" with the same smooth wheel type can opener. Perhaps, too, those who would have employed the "trick" of making a punch hole type partial opening with a beverage type can opener might have found that that "trick" works with a smooth wheel type handled can opener that has on one of its handles a standard beverage punch hole can opener such as on the EKCO Model-884 Three-way Miracle can opener. Such operations are inconvenient.

Other art is also known. See, U.S. Pat. No. 2,784,488 to Olsen et al. for a perforating device. See also, U.S. Pat. Nos. 1,308,272 to Berglund for a punch; 3,491,445 to Gallo for a perforating tool with perforating means mounted on opposed wheels on the ends of pivoted handles; 4,193,191 to Sisco for a turret punch; and 6,282,796 to Lin for hole-punching pliers. Compare, U.S. Pat. Nos. 1,401,821 to Silverman for a perforating iron; 1,645,385 to Kaplan for a perforating wheel; 1,681,667 to Johnston et al. for a marking tool; and 4,502,223 to Brookfield for a hand tool with toothed rotors for dislodging material from a surface. Compare, *Fine Cooking*, "Smooth-edge can openers are a cut above," February/March 2006, pages 32-33.

It would be desirable to ameliorate or solve problems in the art. It would be desirable to provide the art with alternatives.

A FULL DISCLOSURE OF THE INVENTION

In general, the invention provides a can opener for movement along the circumference or other similar boundary of a lid of a can, and which, selectively, can punch cut the lid so that liquid contents in the can can be drained, or can clear cut the lid so that it can be removed for full access to the contents in the can, comprising:

a frame;

a rotating, toothed wheel cutting blade mounted to the frame, which can be driven through the lid through application of pressure against a counterpoised drive wheel that is applied under a lip of the can just outside the lid, and can be moved along an outer boundary of the lid by rotation of the drive wheel; and the counterpoised drive wheel, which is mounted to the frame.

Preferably, a first, perforating relationship can be established at a first distance between the cutting blade and the drive wheel such that the lid of the can can be provided with perforations about its outer boundary; and a second, lid boundary-releasing relationship can be established at a second distance between the cutting blade and the drive wheel, which is less than the first distance, such that the lid of the can can be cut to completely sever the lid from the remainder of the can adjacent the outer boundary for a distance greater than a single perforation.

The invention is useful in opening lids of metal cans.

Significantly, by the invention, the art is advanced in kind. Problems in the art are ameliorated if not overcome, and a viable alternative is provided the art. In particular, the invention provides, in one device and through operation of its cutting and drive wheels, a can opener that can be used to perforate the lid of a can for draining liquids as well as cut through the lid as for accessing drained solid contents of the can, or to accomplish either. Furthermore, a perforation can be provided the lid of the can, which does not drip when draining the liquids; and a lid of a can perforated and cut through especially, when removed from the can, as well as the remainder of the can, can be handled with less chance for cuts to the fingers and thumbs. The invention is efficient to produce and operate.

Numerous further advantages attend the invention.

The drawings form part of the specification hereof. With respect to the drawings, which are not necessarily drawn to scale, the following is briefly noted:

Figure 1:
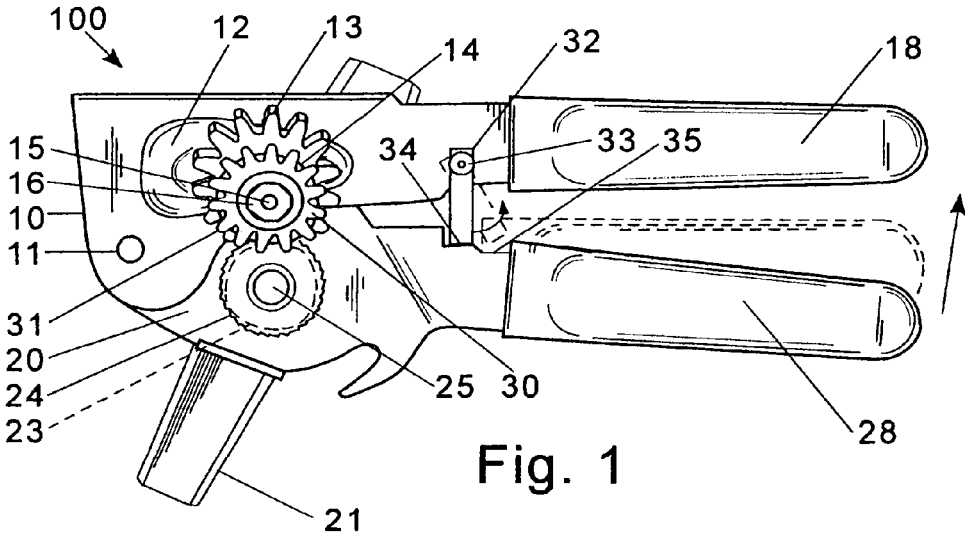
FIG. 1 is a side, elevational view of the invention, embodied as a manual can opener with squeeze handles.
Figure 3:
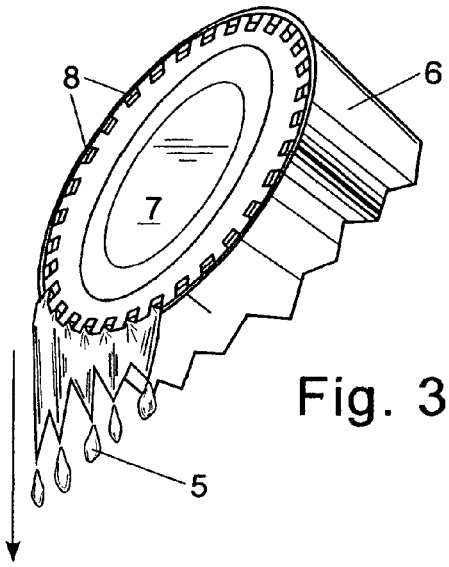
FIG. 3 is a perspective view of the invention, embodied as a can being drained of its liquid contents, without dripping, after it was perforated by the can opener of FIGS. 1 and 2.
Figure 2:
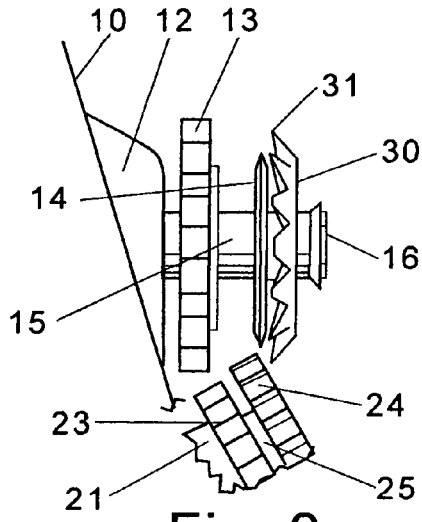
FIG. 2 is a front view of the can opener of FIG. 2, which focuses upon its toothed cutting and drive wheels.
Figure 4:
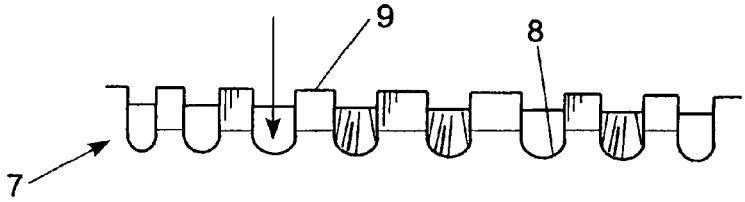
FIG. 4 is a side view of the invention, embodied as the lid of the can of FIG. 3, which was further cut through by the can opener of FIGS. 1 and 2.

The invention can be further understood by the detail set out below, which may be read in view of the drawings. Such is to be taken in an illustrative and not necessarily limiting sense.

The can opener of the invention has a frame, and mounted to the frame a perforating wheel cutting blade. A counterpoised drive wheel is also mounted to the frame, and through it is applied pressure for the cutting blade to penetrate the lid of the can. A first, perforating relationship may be established at a first distance between the cutting blade and the drive wheel, and a second, lid boundary-releasing relationship may be established at a second distance between the cutting blade and the drive wheel, which is less than the first distance; thus, as desired, the can lid can be provided with perforations about its outer boundary for draining liquids, or the can lid can be cut to completely sever it from the remainder of the can adjacent the outer boundary for a distance greater than a single perforation, with complete removal of the lid readily accomplished by further severing around the entire outer boundary.

The present can opener can be provided in any suitable form, and any suitable wheel type can opener of the prior art can be modified with the inventive features hereof. Thus, for example, manual handle-containing can openers and electric can openers are typical forms within the practice of the present invention.

The can opener of the invention can be made of any suitable material. For instance, a suitable metal, metal alloy, plastic and/or wood may be employed for some or all of the components.

The can opener of the invention can be made by any suitable method or process. For example, machining of a suitable metal stock, optionally with the molding of plastic or the working of wooden handles or handle grips, along with standard assembly techniques, may be employed, as those skilled in the art know.

With reference to the drawings, with can opener 100 contents to include liquid contents 5 in metal can 6 can be accessed. The can opener 100 cuts the can 6 by movement along the circumference or other similar boundary of lid 7, and the can opener 100 is able to selectively make punch cuts 8 so that the liquid contents in the can be drained without dripping or to more fully cut so that lid removal for full access to the can contents can be carried out, which leaves complete cut tabs 9. The can opener 100 includes a pivotable frame with first component 10 and second component 20; and includes perforating wheel cutting blade 30.

The first component 10, made substantially with metal, includes pivot pin 11, mount flange 12, and rotatably drivable sprocket 13. The component 10 can have standard, rotatable smooth wheel cutting blade 14, which is press fit onto the sprocket 13 or can be constructed of one piece therewith. Alternatively, such a smooth wheel cutting blade may be absent. Attached to the flange 12 through axle 15 are the sprocket 13 and blade 14, which are secured by fastener 16, say, a nut. First, upper handle 18 may be provided with a plastic sleeve for increased comfort and/or grip.

The second component 20, also made substantially with metal, is pivotally connected to the first component 10 through the pivot pin 11, which passes through a corresponding hole in the component 20; and has rotating driving handle 21 to drive rotatable drive sprocket 23 and counterpoised serrated drive wheel 24. The drive sprocket 23 has teeth that engage corresponding teeth in the sprocket 13 to rotate the latter, and the serrated drive wheel 24 is to be applied under a lip of the can 6 outside the lid 7 as known in the art. Second, lower handle 28 may be provided with a plastic sleeve for increased comfort and/or grip.

The perforating wheel cutting blade 30 is mounted onto the axle 15 and is secured by the nut 16 of the first component 10 of the frame. The blade 30 includes cutting teeth 31. A first, perforating relationship can be established at a first distance between the cutting blade 30 with its teeth 31 and the drive wheel 24 (as well as the cutting blade 14 and the drive wheel 24) by setting of selection arm 32, which is pivotable about pivot 33, at a first position on first shoulder 34. Thus, the lid 7 of the can 6 can be provided with perforations or punch cuts 8 about its outer boundary when the can opener 100 is operated through engagement of the teeth of the rotating sprockets 23, 13. A second, lid boundary-releasing relationship can be established at a second distance between the cutting blade 30 with its teeth 31 and the drive wheel 24 (as well as the blade 14 and the drive wheel 24) less than the first distance by setting the selection arm 32 at a second position on second shoulder 35, which allows the blade 30 with its teeth 31 (and the blade 14) to approach closer the drive wheel 24 and penetrate much further into the lid 7. Thus, lid 7 can be cut to completely sever it from the remainder of the can 6 when the can opener 100 is operated in this second position. A severed lid 7 can thus have left thereon punch cuts 8 and complete cut tabs 9, which are more comfortably gripped than sharp and dangerous lid edges provided by prior art can openers that only have standard smooth wheel cutting blades.

CONCLUSION TO THE INVENTION

The present invention is thus provided. Various feature(s), part(s), step(s), subcombination(s) and/or combination(s) can be employed with or without reference to other feature(s), part(s), step(s), subcombination(s) and/or combination(s) in the practice of the invention, and numerous adaptations and modifications can be effected within its spirit, the literal claim scope of which is particularly pointed out as follows:

What is claimed is:

1. A can opener for movement along the circumference or other similar boundary of a lid of a can, and which, selectively, can punch cut the lid so that liquid contents in the can can be drained, or can clear cut the lid so that it can be removed for full access to the contents in the can, comprising:

a frame;

a rotating, toothed wheel cutting blade mounted to the frame, which can be driven through the lid through application of pressure against a counterpoised drive wheel that is applied under a lip of the can just outside the lid, and can be moved along an outer boundary of the lid by rotation of the drive wheel; and the counterpoised drive wheel, which is mounted to the frame;

wherein a first perforating relationship can be established at a first distance between the cutting blade and the drive wheel such that the lid of the can can be provided with perforations about its outer boundary, the first distance established and limited by a mechanism being in a first position;

and a second, lid boundary-releasing relationship can be established at a second distance between the cutting blade and the drive wheel less than the first distance such that the can lid can be cut to completely sever it from the remainder of the can adjacent the outer boundary for a distance greater than a single perforation, the second distance established by moving said mechanism to a second position.

2. The can opener of claim 1, wherein the perforations provided the lid of the can do not cause dripping when draining liquids from the can and/or the lid of the can as perforated and cut through, when removed from the can, as well as the remainder of the can, can be handled with less chance for cuts to the fingers and thumbs than lids and cans provided from opening cans with only a standard smooth wheel cutting blade can opener.

3. A can opener for cutting open a metal can by movement along a circumference or other similar boundary of a lid of the can, which is able to selectively make punch cuts so that liquid contents in the can be drained without dripping or more fully cut so that lid removal for full access to the can contents can be carried out, which leaves complete cut tabs in the lid, which can opener comprises a pivotable frame with first component and second component, and a perforating wheel cutting blade, wherein:

the first component includes a pivot pin, a mount flange, and a rotatably drivable sprocket, a rotatable smooth wheel cutting blade on the sprocket, wherein said sprocket and blade are attached to the mount flange through an axle secured by fastener;

the second component is pivotally connected to the first component through the pivot pin, which passes through a corresponding hole in the second component; and has a drivable rotatable drive sprocket and counterpoised serrated drive wheel, wherein the drive sprocket has teeth that engage corresponding teeth in the sprocket of the first component to rotate the sprocket of the first component, and the serrated drive wheel is for application under a lip of the can outside its lid; and the perforating wheel cutting blade is mounted onto the axle of the first component and secured thereto, wherein the perforating wheel cutting blade includes cutting teeth;

such that a first, perforating relationship can be established at a first distance between the perforating wheel cutting blade with its teeth and the serrated drive wheel, as well as the rotatable smooth wheel cutting blade and the serrated drive wheel, by setting of a selection arm, which is pivotable about a selection arm pivot, at a first position on a first shoulder so that the lid of the can be provided with perforations or punch cuts about its outer boundary when the can opener is operated through engagement of the teeth of the rotating sprockets of the first and second components; and such that a second, lid boundary-releasing relationship can be established at a second distance between the perforating wheel cutting blade with its teeth and the serrated drive wheel, as well as the rotatable smooth wheel cutting blade and the serrated drive wheel, which is less than the first distance by setting the selection arm at a second position on a second shoulder, which allows the perforating wheel cutting blade with its teeth, and the rotatable smooth wheel cutting blade, to approach closer the serrated drive wheel and penetrate much further into the lid so that the lid can be cut to completely sever it from the remainder of the can when the can opener is operated in this second position.

4. The can opener of claim 3, wherein a manually operated rotating handle is present to drive the rotatable drive sprocket.

* * * * *